US010416599B2

(12) United States Patent
Tanaka et al.

(10) Patent No.: US 10,416,599 B2
(45) Date of Patent: Sep. 17, 2019

(54) FIXING DEVICE HAVING A SUPPORTING PORTION THAT INCLUDES FIRST AND SECOND OPPOSING SURFACES THAT OPPOSE AN INNER SURFACE OF A FILM AND ENGAGING SURFACES THAT ENGAGE WITH A FRAME

(71) Applicant: CANON KABUSHIKI KAISHA, Tokyo (JP)

(72) Inventors: Masaki Tanaka, Kawasaki (JP); Masafumi Maeda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/136,383

(22) Filed: Sep. 20, 2018

(65) Prior Publication Data

US 2019/0086847 A1 Mar. 21, 2019

(30) Foreign Application Priority Data

Sep. 21, 2017 (JP) ..... 2017-181186
Aug. 1, 2018 (JP) ..... 2018-144753

(51) Int. Cl.
*G03G 15/20* (2006.01)

(52) U.S. Cl.
CPC ..... *G03G 15/2057* (2013.01); *G03G 15/2053* (2013.01)

(58) Field of Classification Search
CPC ..... G03G 15/2057; G03G 15/2053; G03G 2215/2035; G03G 2215/2016
See application file for complete search history.

(56) References Cited

U.S. PATENT DOCUMENTS

| | | | | |
|---|---|---|---|---|
| 6,671,488 | B2 | 12/2003 | Izawa et al. | |
| 9,454,118 | B2 | 9/2016 | Tanaka et al. | |
| 9,645,536 | B2 | 5/2017 | Amano | |
| 9,703,242 | B2 | 7/2017 | Tanaka et al. | |
| 2016/0170351 | A1* | 6/2016 | Suzuki | G03G 15/2064 399/329 |
| 2016/0327893 | A1* | 11/2016 | Kim | G03G 15/2053 |

FOREIGN PATENT DOCUMENTS

| | | | |
|---|---|---|---|
| JP | 3814542 | B2 | 8/2006 |
| JP | 2013-161029 | A | 8/2013 |
| JP | 2015-069124 | A | 4/2015 |
| JP | 2017-021067 | A | 1/2017 |

* cited by examiner

*Primary Examiner* — Sandra Brase
(74) *Attorney, Agent, or Firm* — Venable LLP

(57) ABSTRACT

A fixing device includes a frame, a film, a component portion engaging with the frame, and a roller that forms a nip with the film. The component portion includes a supporting portion provided inside the film, and including a first opposing surface opposing an inner surface of the film, and a second opposing surface opposing the inner surface of the film. Each of the first opposing surface and the second opposing surface is a surface forming a substantially right angle with an engaging surface, which is a surface on which the component portion engages with the frame and on which the component portion opposes a flat surface portion of the frame. When the component portion is seen in the longitudinal direction of the film, a contour of the first opposing surface is greater than a contour of the second opposing surface.

8 Claims, 13 Drawing Sheets

FIXING DEVICE HAVING A SUPPORTING PORTION THAT INCLUDES FIRST AND SECOND OPPOSING SURFACES THAT OPPOSE AN INNER SURFACE OF A FILM AND ENGAGING SURFACES THAT ENGAGE WITH A FRAME

This application claims the benefit of Japanese Patent Application No. 2017-181186, filed on Sep. 21, 2017, and Japanese Patent Application No. 2018-144753, filed on Aug. 1, 2018, both of which are hereby incorporated by reference herein in their entireties.

FIELD OF THE INVENTION AND RELATED ART

The present invention relates to a fixing device mountable to an image forming apparatus, such as an electrophotographic copying machine or an electrophotographic printer.

As the fixing device mounted in the copying machine or printer of an electrophotographic type, a fixing device of a film heating type has been known. The fixing device of this type includes a rotatable cylindrical film, a plate-like heater contacting an inner peripheral surface of the film, and a pressing roller for forming a nip in cooperation with the heater through the film. A recording material, on which an unfixed toner image is formed, is heated while being fed through the nip, whereby the toner image is fixed on the recording material.

In the fixing device of the film heating type, with respect to a longitudinal direction of the film perpendicular to a recording material feeding direction, in some cases, due to a component tolerance and an assembly tolerance in manufacturing of the device, a deviation in parallelism of the pressing roller and the film, and localization of a pressure distribution of the nip generate. In that case, a force for moving the film in a film longitudinal direction (hereafter, this force is referred to as a film shifting force) acts, so that a shift of the film in the film longitudinal direction generates.

Therefore, in a fixing device disclosed in Japanese Patent No. 3814542, a regulating (limiting) member opposing a film end portion is provided, and, when the shift of the film generates, the film end portion is received by a regulating (limiting) portion of the regulating member. The regulating portion is provided with a surface having an inner diameter gradually decreasing toward an outside thereof with respect to the film longitudinal direction, and by the surface, breakage of the film end portion is suppressed.

In the fixing device of the film heating type, it has been required that the breakage of the film end portion is suppressed by reducing the film shifting force.

SUMMARY OF THE INVENTION

A principal object of the present invention is to provide a fixing device capable of reducing a shifting force of a cylindrical film and capable of suppressing breakage of a film end portion.

According to one aspect, the invention provides a fixing device for fixing an image, formed on a recording material, on the recording material, the fixing device comprising a frame, a component portion engaging with the frame, a cylindrical film rotatable while being contactable to the recording material, a supporting portion provided in an inside space of the film at a position opposing a longitudinal end portion of the film, the supporting portion being provided as a portion of the component portion, and a roller contacting an outer peripheral surface of the film and configured to form a nip, in which the recording material is nipped and fed, between itself and the film, wherein the supporting portion includes a first opposing surface opposing an inner surface of the film at the longitudinal end portion of the film and a second opposing surface opposing the inner surface of the film on an inside of the first opposing surface with respect to a longitudinal direction of the film, wherein each of the first opposing surface and the second opposing surface is a surface forming a substantially right angle with an engaging surface, which is a surface on which the component portion engages with the frame and on which the component portion opposes a flat surface portion of the frame, and wherein, when the component portion is seen in the longitudinal direction of the film, a contour of the first opposing surface is greater than a contour of the second opposing surface.

Further features of the present invention will become apparent from the following description of exemplary embodiments with reference to the attached drawings.

Figure 8:
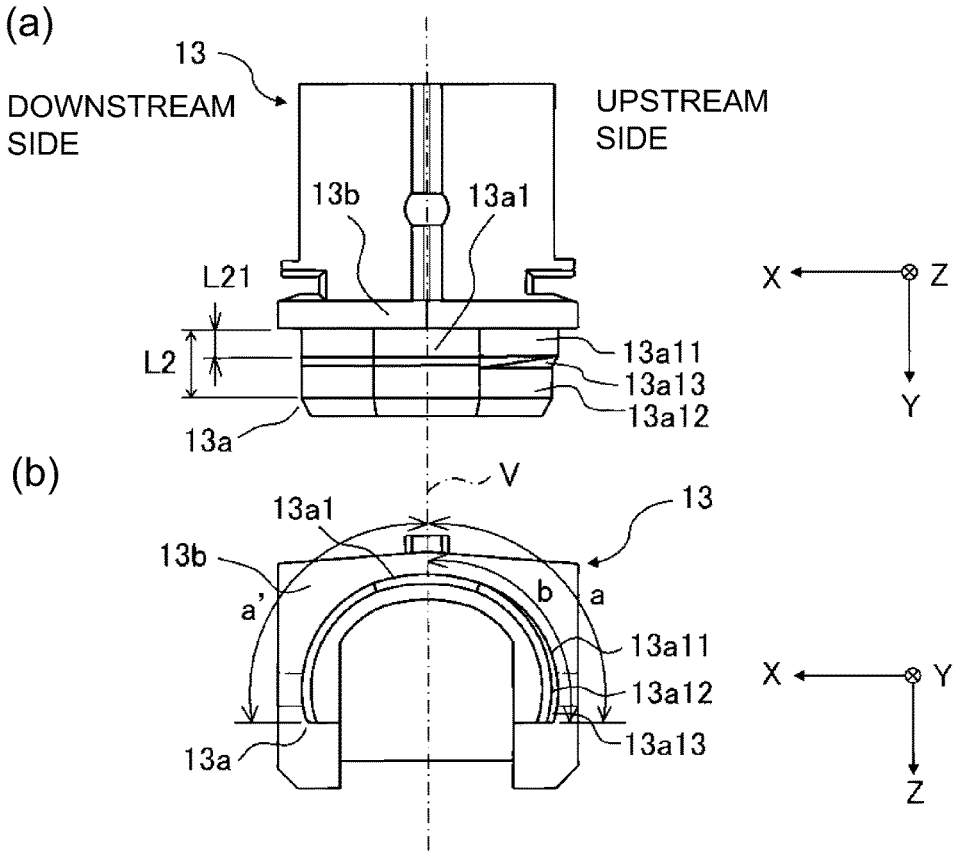

Parts (a) and (b) of FIG. 8 are schematic views for illustrating a first opposing surface and a second opposing surface of the flange.

Figure 9:
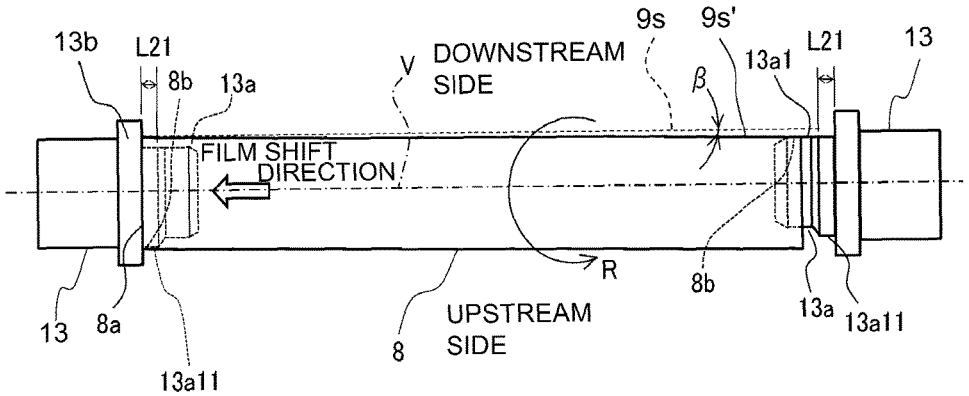

FIG. 9 is a schematic view showing the film and the left and right flanges each provided with the first opposing surface and the second opposing surface on the upstream-side of the recording material feeding direction.

Figure 10:
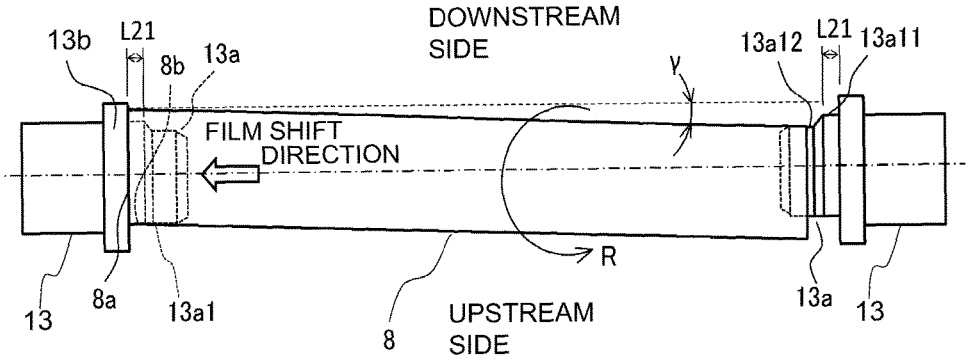

FIG. 10 is a schematic view showing the film and the left and right flanges each provided with the first opposing surface and the second opposing surface on a downstream side of the recording material feeding direction.

Figure 11:
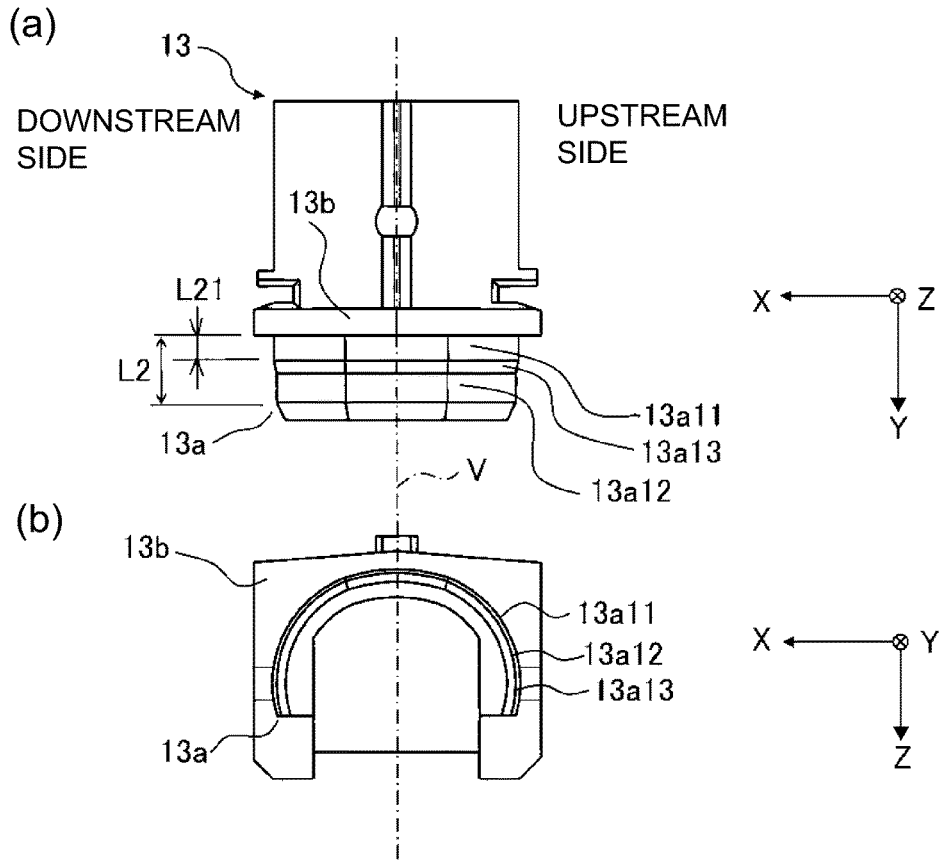

Parts (a) and (b) of FIG. 11 are schematic views for illustrating a first opposing surface and a second opposing surface of a flange of a fixing device according to Embodiment 2.

Figure 12:
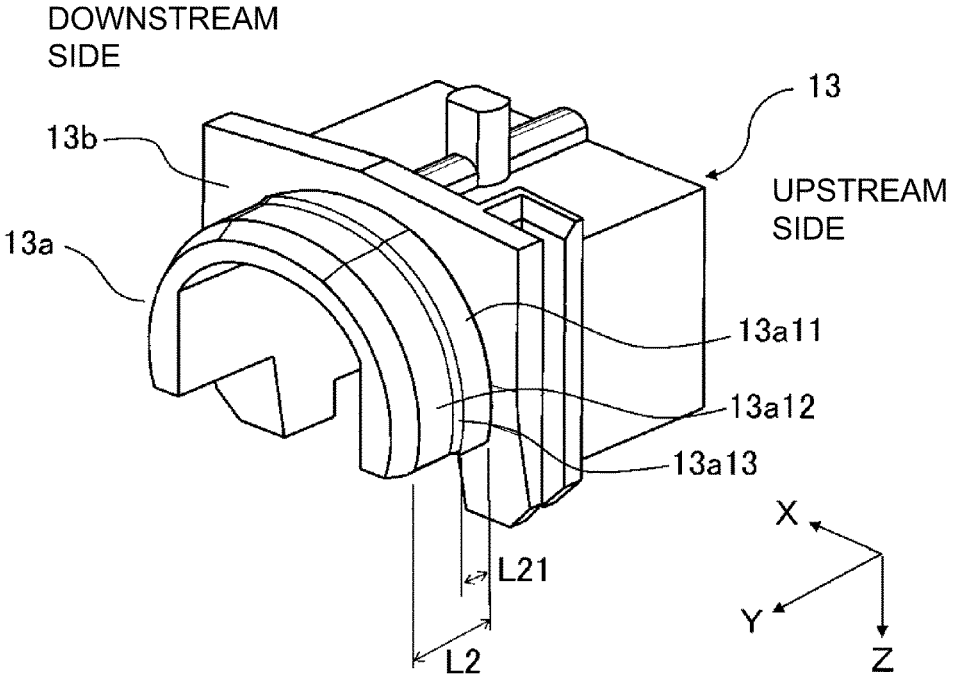

FIG. 12 is a perspective view showing the flange of FIG. 11.

Figure 13:
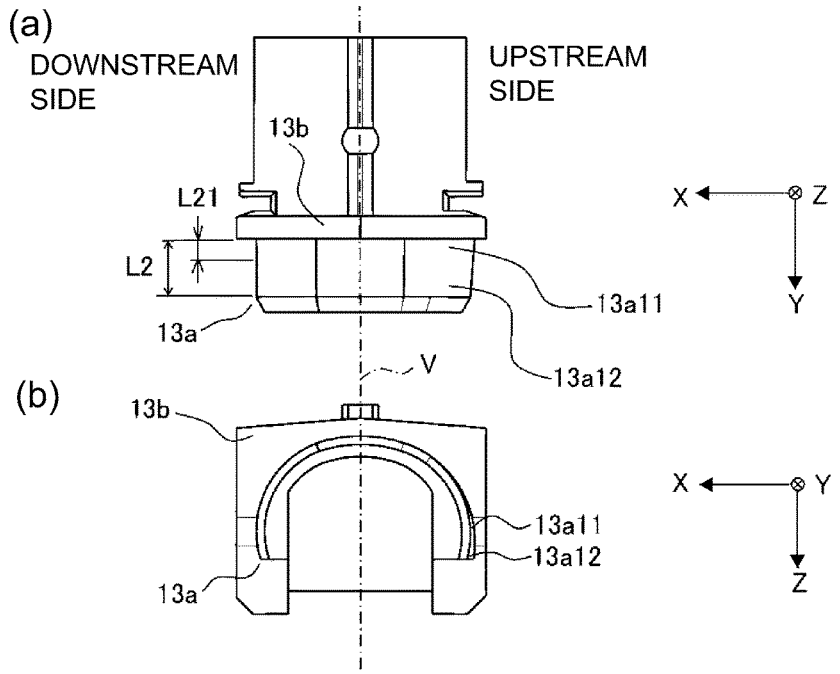

Parts (a) and (b) of FIG. 13 are schematic views for illustrating a first opposing surface and a second opposing surface of a flange of a fixing device according to Embodiment 3.

Figure 14:
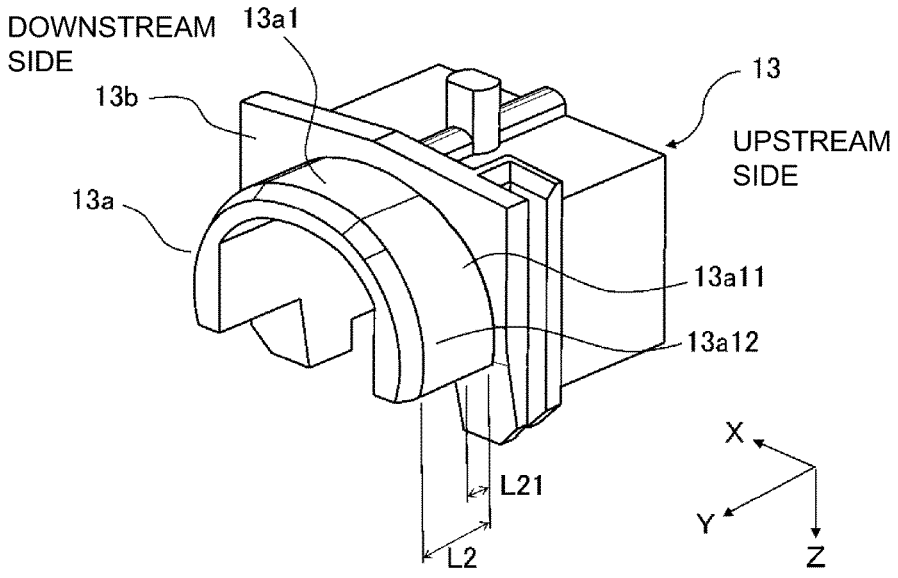

FIG. 14 is a perspective view showing the flange of FIG. 13.

Figure 15:
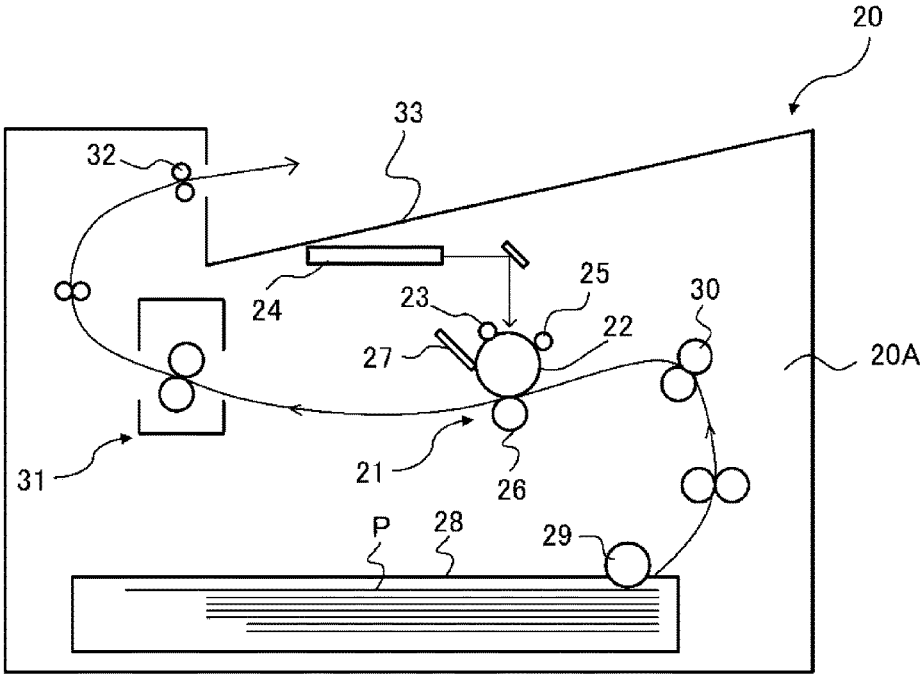

FIG. 15 is a schematic view showing a structure of an image forming apparatus.

Figure 16:
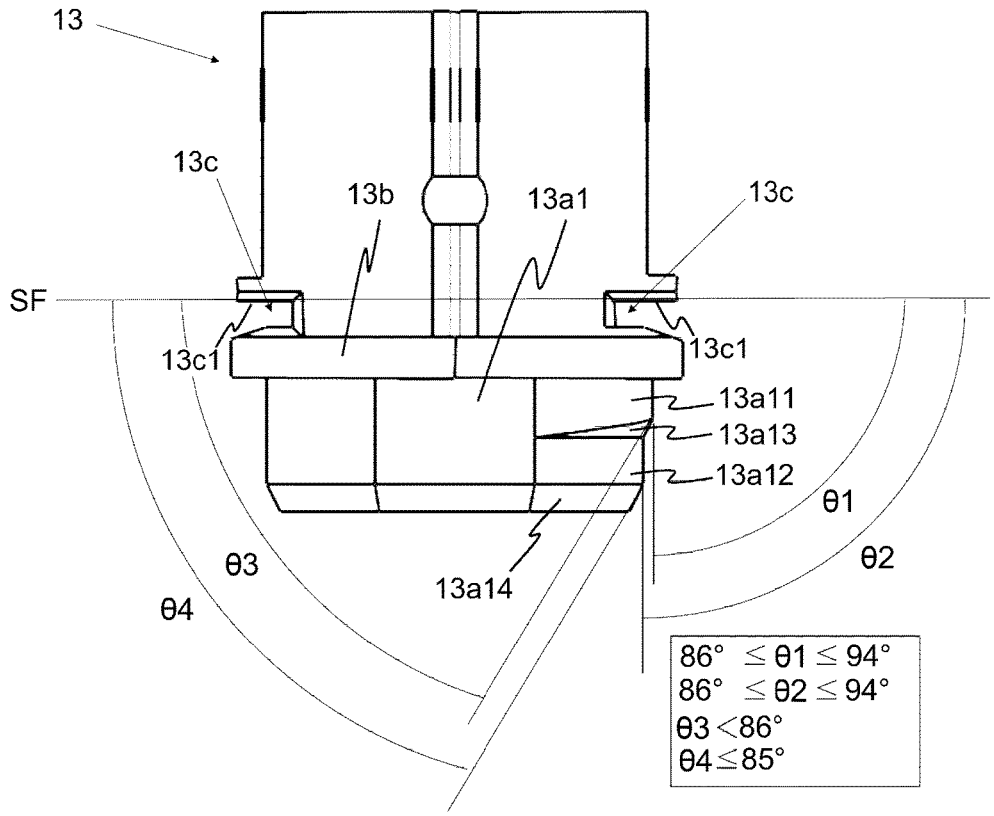

FIG. 16 is a schematic view for illustrating angles of opposing surfaces.

DESCRIPTION OF EMBODIMENTS

Embodiments of the present invention will be described with reference to the drawings. Although these embodiments are preferred embodiments of the present invention, the present invention is not limited to the following embodiments, and various constitutions thereof can be replaced with other various known constitutions within a scope of a concept of the present invention.

Embodiment 1

(1) Image Forming Apparatus 20

With reference to FIG. 15, an image forming apparatus 20 in which a fixing device 31 according to the present invention is mounted will be described. FIG. 15 is a schematic view showing a general structure of an example of the image forming apparatus (a monochromatic printer in this embodiment) 20 using an electrophotographic recording technique.

In the image forming apparatus 20, an image forming portion 21 for forming an image on a recording material P includes a photosensitive drum 22, a charging member 23, a laser scanner 24, a developing device 25, a transfer member 26, and a cleaner 27 for cleaning an outer peripheral surface of the photosensitive drum 22. An operation of the image forming portion 21 is well known, and, therefore, will be omitted from detailed description.

A recording material P accommodated in a cassette 28 in an apparatus main assembly 20A is fed one by one by rotation of a roller 29. Then, the recording material P is fed to a transfer portion, formed by the photosensitive drum 22 and the transfer member 26, by rotation of a roller pair 30. The recording material P, on which the toner image is transferred at the transfer portion, is sent to the fixing device (fixing portion) 31, and the toner image is heat-fixed on the recording material P by the fixing device 31. The recording material P coming out of the fixing device 31 is discharged onto a tray 33 by rotation of a roller pair 32.

(2) Fixing Device 31

(2-1) Device Structure

Figure 1:
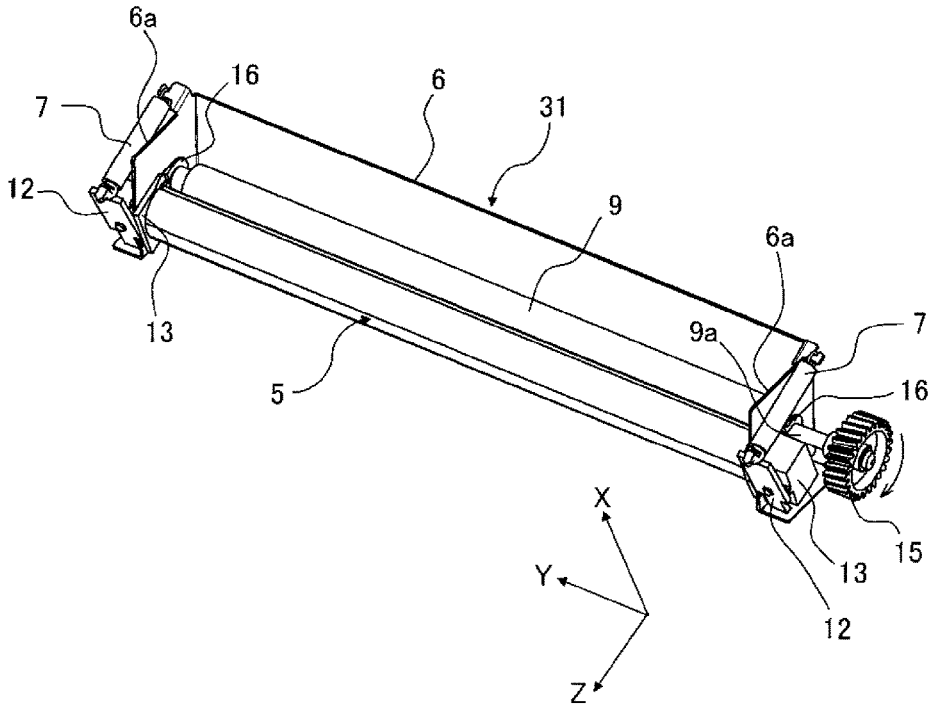
FIG. 1 is a perspective view showing a schematic structure of a fixing device according to Embodiment 1.
Figure 2:
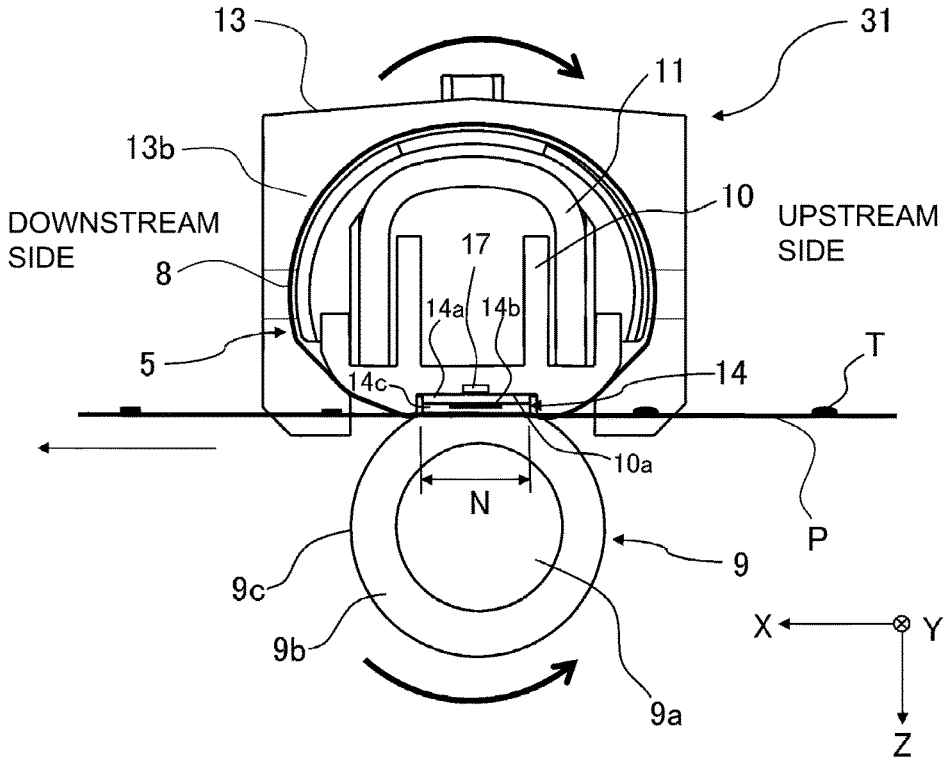
FIG. 2 is a sectional view showing the schematic structure of the fixing device according to Embodiment 1.

The fixing device 31 in this embodiment is a fixing device of a film heating type. The fixing device 31 will be described with reference to FIGS. 1 and 2. FIG. 1 is a perspective view showing a schematic structure of an entirety of the fixing device 31. FIG. 2 is a sectional view showing the schematic structure of the fixing device 31. In FIGS. 1 and 2, X is a recording material feeding direction, Y is a longitudinal direction of the fixing device 31 (film 8) perpendicular to the recording material feeding direction X, and Z is a recording material thickness direction.

The fixing device 31 includes a heating unit 5, a pressing roller 9 as a rotatable heating member, left and right flanges 13 as regulating (limiting) members, and a frame 6 for supporting the heating unit 5, the pressing roller 9, and the flanges 13. In this embodiment, each of the flanges 13 corresponds to a component portion engaging with the frame 6.

As shown in FIG. 2, the pressing roller 9 includes a metal core 9*a*, an elastic layer 9*b* formed on an outer peripheral surface of the metal core 9*a* and consisting of a silicone rubber, a fluorine-containing rubber, or the like, and a parting layer 9*c* formed on an outer peripheral surface of the elastic layer 9*b* and consisting of a perfluoroalkoxy alkane (PFA) such as tetrafluoroethylene-perfluoroalkylvinyl ether copolymer, or polytetrafluoroethylene (PTFE).

As regards the pressing roller 9, as shown in FIG. 1, both end portions of the metal core 9*a* are rotatably supported by left and right side plates 6*a* of the frame 6 through bearing members 16 with respect to the direction Y.

As shown in FIG. 2, the heating unit 5 includes a rotatable cylindrical film 8, a plate-like heater 14 as a heating member, a holder 10 as a supporting member for supporting the heater 14, and a stay 11 as a pressing member.

The holder 10, formed of a heat-resistant resin material, supports the heater 14 at a recessed portion 10*a* provided along the direction Y on a flat surface thereof on the pressing roller 9 side. On a flat surface of the holder 10 on a side opposite from the pressing roller 9 side, the stay 11, formed of metal or a heat-resistant resin material, is provided. The stay 11 is formed in a U-shape in cross section in order to reinforce the holder 10. The holder 10, which not only supports the heater 14 but also on which the stay 11 is provided, is inserted into a hollow portion of the film 8.

The heater 14 includes a thin elongated ceramic-made substrate 14*a* extending along the direction Y. On a surface of the substrate 14*a* on the pressing roller 9 side, a heat generating resistance layer 14*b*, such as silver-palladium, generating heat by energization, is provided along a longitudinal direction of the substrate 14*a*. The heat generating resistance layer 14*b* is coated with a glass coating as a protective layer 14*c* provided on the substrate 14*a* for ensuring protection, and having an insulating property of the heat generating resistance layer 14*b*.

The film 8 is a thin elongated member extending along the direction Y. As the film 8, a single layer film or a composite layer film is used. As the single layer film, a sleeve formed of a heat-resistant resin material is used. As the composite layer film, a film in which a sleeve, obtained by subjecting an about 50 μm-thick polyimide to heat-resistant treatment or by subjecting stainless steel (SUS), or the like, to a thin film process, is used as a base layer, and, on a surface of the sleeve, a parting layer is formed of PTFE, PFA, or the like.

A structure of the flanges 13 will be described with reference to FIG. 3.

Figure 3:
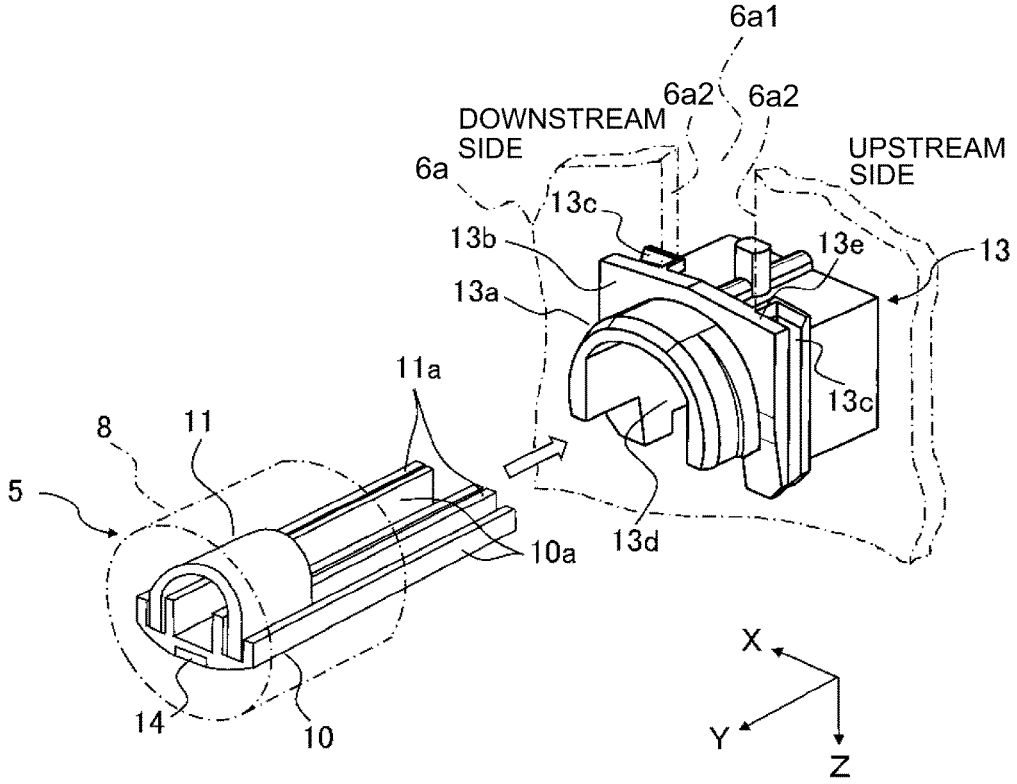
FIG. 3 is a perspective view showing a right-side flange of FIG. 1.

FIG. 3 is a perspective view showing the right side flange 13 of FIG. 1. A left side flange 13 has the same structure as the flange 13 of FIG. 3 and, therefore, will be omitted from detailed description.

The flange 13 is provided on both sides of the film 8 with respect to the longitudinal direction of the film 8. At side surfaces of the flange 13 on an upstream side and a downstream side with respect to the recording material feeding direction X of the flange 13, groove portions 13*c* are provided along the direction Z. On the other hand, a side plate 6*a* is provided with supporting portions 6*a*2 formed on an upstream side and a downstream side with respect to the recording material feeding direction X, so that a recessed portion 6*a*1 is formed along the direction Z. Further, with respect to the direction Z, the groove portions 13*c* of the flange 13 are engaged with the supporting portions 6*a*2 of the side plate 6*a*, whereby the flange 13 is supported by the side plate 6*a*.

Further, the flange 13 includes a regulating (limiting) portion 13*b* for regulating (limiting) movement of the film 8 in the longitudinal direction with respect to the direction Y. Further, the flange 13 includes a supporting portion 13*a* for supporting an end portion of the film 8, and a hole 13*d* for supporting an end portion of the heating unit 5.

The regulating portion 13*b* is formed in a shape that is larger than an outer diameter with respect to the direction Y.

As a result, an end surface 8*a* of the film 8 is capable of abutting against the regulating portion 13*b*.

With respect to the direction X, the supporting portion 13*a* is provided at a substantially central portion of the regulating portion 13*b*. The supporting portion 13*a* projects toward the film end surface 8*a* in the direction Y. This supporting portion 13*a* is formed in a semicircular (arcuate) shape capable of being inserted into the hollow portion of the film 8.

Inside the supporting portion 13*a*, the hole 13*d* is provided along the direction Y. This hole 13*d* penetrates the regulating portion 13*b*. In this hole 13*d*, end portions 10*a* and 11*a* of the guide 10 for the heating unit 5 and of the stay 11 are inserted and engaged, whereby the heating unit 5 is supported by the flange 13.

The fixing device 31 includes, as shown in FIG. 1, a pressing plate 12 swingable relative to the flange 13 in the direction Z. The pressing plate 12 is press-contacted to a surface-to-be-pressed 13*e* (FIG. 3) of the flange 13 by a pressing force of a pressing spring 7 locked to the side plate 6*a*, whereby the flange 13 is pressed in the direction Z.

As shown in FIG. 2, the flange 13 pressed in the direction Z presses the holder 10 through the stay 11. The holder 10 presses a protective layer 14*c* of the holder 10 toward an inner peripheral surface (inner surface), and further causes the outer peripheral surface of the film 8 to press-contact an outer peripheral surface of the pressing roller 9. As a result, the elastic layer 9*b* of the pressing roller 9 is depressed and elastically deformed, so that a nip N having a predetermined width with respect to the direction X is formed by the film 8 surface and the pressing roller 9 surface.

(2-2) Heat Fixing Process Operation

As shown in FIG. 1, a gear 15 provided at one end portion of the metal core 9*a* of the pressing roller 9 is rotationally driven in an arrow direction by a motor (not shown). Then, the pressing roller 9 is rotated in an arrow direction shown in FIG. 2, and the film 8 is rotated in an arrow direction shown in FIG. 2 by rotation of the pressing roller 9.

When electrical power is supplied from an unshown power (voltage) source to the heat generating resistance layer 14*b* of the heater 14, the heat generating resistance layer 14*b* generates heat, so that the heater 14 is abruptly increased in temperature. A temperature controller (not shown) acquires a heater temperature detected by a thermistor 17 (FIG. 2) as a temperature detecting member and controls electrical power supplied to the heat generating resistance layer 14*b* so as to maintain the heater temperature at a predetermined fixing temperature (target temperature).

The recording material P carrying an unfixed toner image T thereon is heated while being fed through the nip N, whereby the toner image is fixed on the recording material P.

(2-3) Supporting Portion 13*a* of Flange 13

The supporting portion 13*a* of the flange 13 will be described with reference to FIGS. 4 and 5.

Figure 4:
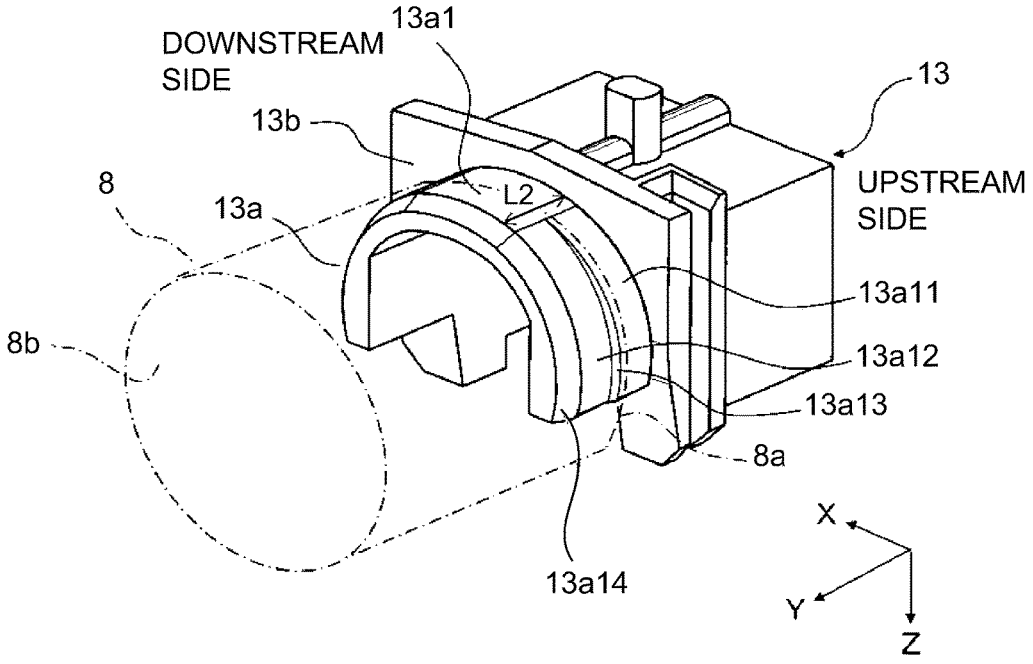
FIG. 4 is a perspective view when the right-side flange of FIG. 1 and a right-side end portion of a film supported by a supporting portion of this flange are seen from an upstream-side of a recording material feeding direction.

FIG. 4 is a perspective view when the right side flange 13 of FIG. 1 and a right side end portion of the film 8 supported by the supporting portion 13*a* of this flange 13 are seen from an upstream-side of the recording material feeding direction.

Figure 5:
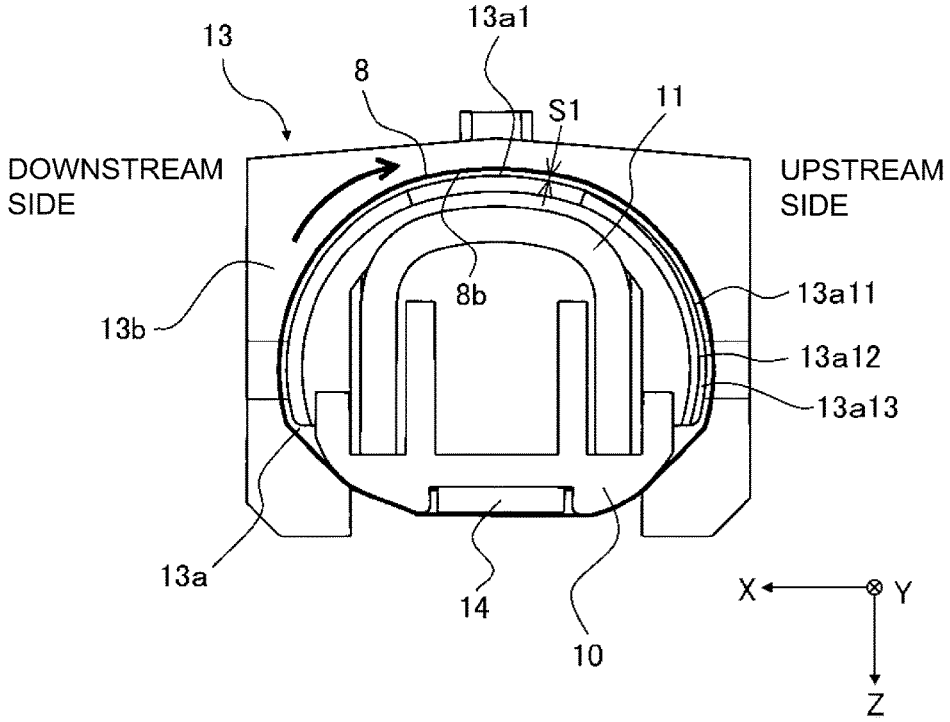
FIG. 5 is a schematic view showing a positional relationship between the supporting portion of the right-side flange of FIG. 1 and the film regulated in rotation orbit by the supporting portion.

FIG. 5 is a schematic view showing a positional relationship between the supporting portion 13*a* of the right side flange 13 of FIG. 1 and the film 8 regulated in rotation orbit by the supporting portion 13*a*.

As shown in FIG. 4, the supporting portion 13*a* of the flange 13 includes an opposing surface 13*a*1 at a periphery of the supporting portion 13*a*. The opposing surface 13*a*1 is formed in a semicircular shape with respect to a circumferential direction of the film 8 so that the film 8 can smoothly rotate. A film inner surface 8*b* is slid on this opposing surface 13*a*1, whereby the rotation orbit of the film 8 is regulated.

Due to a component tolerance and an assembling tolerance in manufacturing of the device, when a gap between the film inner surface 8*b* and the opposing surface 13*a*1 of the supporting portion 13*a* decreases, or when a peripheral length of the opposing surface 13*a*1 is greater than a film inner peripheral length, a sliding resistance of the film inner surface 8*b* relative to the opposing surface 13*a*1 increases. Then, there is a liability that a film slip such that the film 8 slips on the pressing roller 9 and film torsion due to a rotational speed difference between an end portion and a central portion of the film 8 generate. For that reason, as shown in FIG. 5, between the film inner surface 8*b* and the opposing surface 13*a*1, a proper gap S1 set by taking the component tolerance and the assembling tolerance in manufacturing of the device into consideration is ensured, so as not to prevent rotation of the film 8.

Next, a relationship between a length L1 of the film 8 and a distance L between the regulating portions 13*b* of the left side and right side flanges 13 will be described with reference to FIG. 6.

Figure 6:
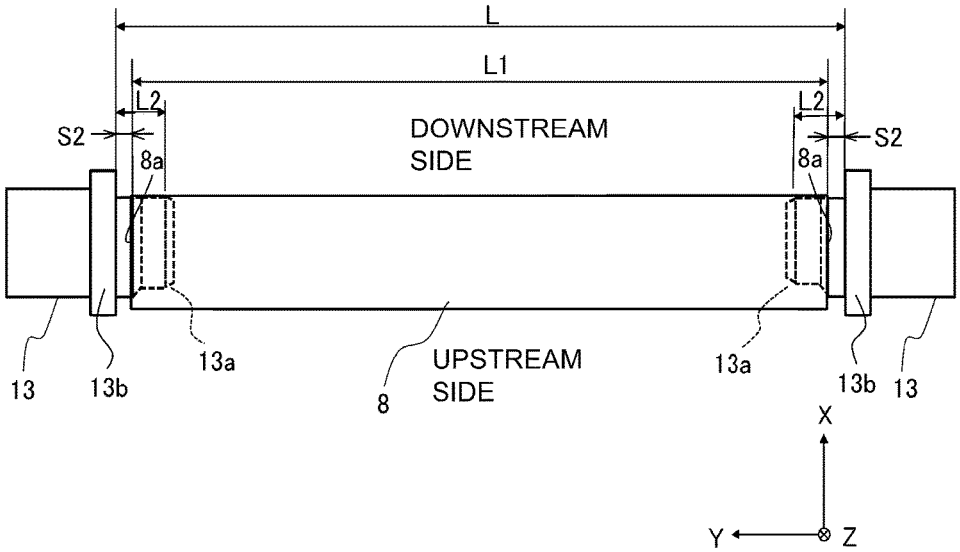
FIG. 6 is a schematic view showing a relationship between a length of the film and a distance between regulating portions of left and right flanges.

FIG. 6 is a schematic view showing the relationship between the length L1 of the film 8 and the distance L between the regulating portions 13*b* of the left side and right side flanges 13.

In a case in which a shift (shift movement) of the film 8 generates, the film end surface 8*a* runs against the regulating portion 13*b* of the flange 13, whereby the shift of the film 8 is regulated (limited). When the distance L between the regulating portions 13*b* of the left side and right side flanges 13 is less than the length L1 due to the component tolerance and the assembling tolerance in manufacturing of the device, the regulating portion 13*b* and the film end surface 8*a* interfere with each other, so that buckling generates at the film end portion. For that reason, L is set so as to be greater than L1 in consideration of the tolerances of component portions constituting the left side and right side flanges 13 and the heating unit 5 and thermal expansion of the film 8.

Accordingly, with respect to the direction Y, between each of the regulating portions 13*b* of the left side and right side flanges 13 and an associated one of the film end surfaces 8*a*, a gap S2 varying depending on the above-described tolerances and the thermal expansion of the film 8 exists. That is, the film 8 is movable in the film longitudinal direction correspondingly to the gap S2. For that reason, as shown in FIGS. 4 and 6, a length L2 of the opposing surface 13*a*1 of the supporting portion 13*a* is a length (L2>S2) such that the above-described tolerances and the thermal expansion of the film 8 are taken into consideration and the film 8 is prevented from falling out of the supporting portion 13*a* with respect to the film longitudinal direction.

Here, a generation mechanism of generation of a shift of the film 8 will be described while making reference to FIG. 7 (Comparison Example 1).

Figure 7:
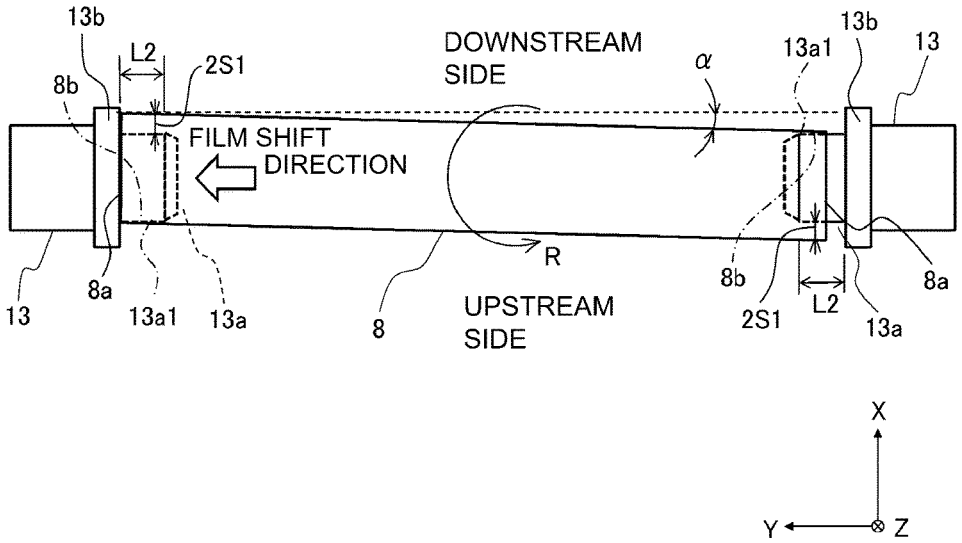
FIG. 7 shows a state when the film shifts in a film longitudinal direction.

FIG. 7 is a schematic view showing a state when the shift of the film 8 generates. In FIG. 7, a positional relationship between the film 8 and each of the left side and right side flanges 13. In FIG. 7, R is a rotational direction of the film 8.

When the pressing roller 9 and the film 8 rotate, the pressing roller 9 and the film 8 are not always parallel to each other, but have a crossing angle due to the above-described tolerances in some cases. Further, even when the pressing roller 9 and the film 8 are parallel to each other, there are also cases in which a difference in pressing force generates between the left and right pressing springs 7 and in which a difference in rotational speed generates between left and right end portions of the film 8 depending on an attitude of the recording material P fed to the nip N.

In such cases, as shown in FIG. 7, the inner surface 8*b* of the right side film end portion contacts a downstream regulating portion of the opposing surface 13*a*1 of the right side flange 13 with respect to the direction X in some instances. Then, on the right side end portion side of the film 8, the film 8 inclines toward the upstream side correspondingly to a gap 2S1 corresponding to twice the gap S1.

When the film 8 inclines toward the right end portion side, during rotation of the film 8 by the pressing roller 9, a force (film shifting force) for moving the film 8 toward the left-side flange 13 in the film longitudinal direction acts on the film 8, so that the shift of the film 8 generates. At this time, the film shifting force becomes greater with an increasing degree of inclination of the film 8.

The film 8 is shifted toward the left side flange 13 by the film 8 shifting force, so that the film end surface 8*a* abuts against the regulating portion 13*b*. At this time, the film inner surface 8*b* slides on an upstream regulating portion of the opposing surface 13*a*1 of the supporting portion 13*a* of the flange 13 on the film shifting direction side with respect to the direction X. As a result, on the downstream side with respect to the recording material feeding direction, between the opposing surface 13*a*1 and the film inner surface 8*b*, a gap 2S1 corresponding to twice the gap S1 generates. As a result, the film 8 inclines toward the upstream side with respect to the recording material feeding direction so that the right end portion side of the film 8 inclines relative to the left end portion side of the film 8 by an angle α.

(2-4) Opposing Surfaces of Supporting Portion 13*a* on Upstream Side with Respect to Recording Material Feeding Direction Opposing surfaces 13*a*11 and 13*a*12 of the supporting portion 13*a* on the upstream side with respect to the recording material feeding direction will be described with reference to parts (a) and (b) of FIG. 8.

Part (a) of FIG. 8 is a schematic view when the flange 13 is seen from a side opposite from the pressing roller 9, and part (b) of FIG. 8 is a schematic view when the flange 13 is seen from an outside thereof with respect to the film longitudinal direction. In parts (a) and (b) of FIG. 8, V represents a phantom perpendicular plane (phantom plane) perpendicular to a center of a nip N with respect to the recording material feeding direction X.

As described above, in order to reduce the film shifting force by decreasing the degree of inclination of the film 8, there is a need to decrease the gap S1 between the film inner surface 8*b* and the opposing surface 13*a*1 of the supporting portion 13*a* of the flange 13.

When a peripheral length of the supporting portion 13*a* in a regulating portion of the opposing surface 13*a*1 is set at a large value, and, as a result, the gap S1 is further decreased due to the above-described tolerances, a contact pressure between the film inner surface 8*b* and the opposing surface 13*a*1 when the film 8 rotates becomes high. Further, with respect to the direction Y, with a longer regulating surface in which the contact pressure between the film inner surface 8*b* and the opposing surface 13*a*1 becomes high, the film 8 is harder to rotate, so that a risk of generation of the film slip, the film torsion, and the like, becomes large.

As shown in parts (a) and (b) of FIG. 8, the opposing surface 13*a*1 of the supporting portion 13*a* includes a first opposing surface 13*a*11 and a second opposing surface 13*a*12 as two or more opposing surfaces, different in length of arc, on the side upstream of the phantom plane V with respect to the recording material feeding direction X. As shown in FIG. 16, the first opposing surface 13*a*11 and the second opposing surface 13*a*12 are surfaces forming substantially right angles θ1 and θ2, respectively, with an engaging surface 13*a*1, which is a surface where the component portion, i.e., the flange 13, engages with the frame 6 and which is a surface where the component portion 13 opposes a flat surface portion of the frame 6. Specifically, the first opposing surface 13*a*11 and the second opposing surface 13*a*12 are surfaces forming the angles θ1 and θ2, respectively, with an engaging surface 13*c*1, each in arrange of 86° or more and 94° or less. Incidentally, a plane SF is a phantom plane along which the engaging surfaces 13*c*1 are extended.

With respect to the direction Y, the first opposing surface 13*a*11 is provided at a position close to the regulating portion 13*b*, and the second opposing surface 13*a*12 is provided at a position remote from the regulating portion 13*b*. The first opposing surface 13*a*11 close to the regulating portion 13*b* is greater in peripheral length extending along the inner surface 8*b* of the film 8 than the second opposing surface 13*a*12 remote from the regulating portion 13*b*. Each of these opposing surfaces 13*a*11 and 13*a*12 is a surface of regulating the rotation orbit of the film 8 in contact with the film inner surface 8*b*. Further, the peripheral length at the position in which the first opposing surface 13*a*11 is provided is greater than the peripheral length at the position where the opposing surface 13*a*1 in Comparison Example 1, shown in FIG. 7, is provided, and the peripheral length at the position where the second opposing surface 13*a*12 is provided is not more than the peripheral length at the position in which the opposing surface 13*a*1 in Comparison Example 1, shown in FIG. 7, is provided.

The first opposing surface 13*a*11 and the second opposing surface 13*a*12 will be further described specifically.

On the basis of the perpendicular plane V, a length of an arc of the first opposing surface 13*a*11 on the upstream side with respect to the direction X is a, and a length of an arc of the first opposing surface 13*a*11 on the downstream side with respect to the direction X is a'. In this embodiment, length a=length a' holds. Further, on the basis of the perpendicular plane V, when a length of an arc of the second opposing surface 13*a*12 on the upstream side with respect to the direction X is b, the length b is made less than the length a. On the basis of the perpendicular plane V, the length of the arc of the first opposing surface 13*a*11 on the downstream side with respect to the direction X and a length of an arc of the second opposing surface 13*a*12 on the downstream side with respect to the direction X are the same (i.e., contours of these opposing surfaces on the downstream side with respect to the direction X are the same). Further, a length L21 of the first opposing surface 13*a*11 with respect to the direction Y is less than a total length L2 of the opposing surface 13*a*1 with respect to the direction Y. The total length L2 of the opposing surface 13*a*1 in this embodiment is equal to a total length L2 of the opposing surface 13*a*1 in Comparison Example 1, shown in FIG. 7. Accordingly, the flange 13 in this embodiment includes the first opposing surface 13*a*11, which is a regulating portion with the length L21 less than the total length L2 of the opposing surface 13*a*1 in Comparison Example 1, shown in FIG. 7, and which is a regulating portion with a contour greater than a contour of the opposing surface 13*a*1 in Comparison Example 1.

A stepped portion between the first opposing surface 13*a*11 and the second opposing surface 13*a*12 constitutes an inclined surface 13*a*13 smoothly connecting the first opposing surface 13*a*11 and the second opposing surface 13*a*12. A surface 13*a*14 is a tapered surface provided at an outer end of the supporting portion 13*a*. As shown in FIG. 16, an angle θ3 formed between the inclined surface 13*a*13 and the engaging surface 13*a*1 is less than 86°, and an angle θ4 formed between the tapered surface 13*a*14 and the engaging surface 13*c*1 is not more than 85°.

In a case in which the film end surface 8*s* abuts against the regulating portion 13*b* of the flange 13, the film inner surface 8*b* slides with an upstream side portion of the first opposing surface 13*a*11 with respect to the direction X. A sliding regulating portion is the regulating portion with the length L21. The surface shape of the first opposing surface 13*a*11 is an arcuate shape, and, therefore, the film 8 smoothly rotates.

On the other hand, in in which the film end surface 8*a* does not abut against either one of the regulating portions 13*b* of the left side and right side flanges 13, the film inner surface 8*b* slides on either one or both of the first opposing surface 13*a*11 and the second opposing surface 13*a*12. Regions in which the rotation orbit of the film 8 is regulated by the first opposing surface 13*a*11 and the second opposing surface 13*a*12 change due to the above-described tolerances and the thermal expansion of the film 8. For that reason, also, the surface shape of the second opposing surface 13*a*12 is an arcuate shape in which the film 8 can smoothly rotate.

Accordingly, the rotation orbit of the film 8 can also be regulated by the second opposing surface 13*a*12, and, therefore, even when the length L21 of the first opposing surface 13*a*11 is made less than the length L2 necessary to prevent the film 8 from falling out of the supporting portion 13*a*, it is possible to reduce degrees of the generations of the film slip and the film torsion.

Next, the reason why the first opposing surface 13*a*11 and the second opposing surface 13*a*12 are provided will be described while making reference to FIG. 9 (Embodiment 1) and FIG. 10 (Comparison Example 2).

FIG. 9 is a schematic view showing the left side and right side flanges 13 each provided with the first opposing surface 13*a*11 and the second opposing surface 13*a*12 and showing the film 8. FIG. 10 is a schematic view showing a Comparison Example 2.

As shown in FIGS. 9 and 10, due to a variation in component portion tolerance in manufacturing with respect to the film longitudinal direction of the film 8, the film 8 disconnects from the regulating portion of the first opposing surface 13*a*11 of the flange 13 on the opposite side from the film shifting direction, so that the rotation orbit of the film 8 cannot be regulated by this regulating portion in some instances.

As shown in FIG. 9, the film inner surface 8*b* slides on the opposing surface 13*a*1 of the supporting portion 13*a* of the flange (right side flange) 13 on the opposite side from the film shifting direction, the rotation orbit of the film 8 cannot be regulated by the first opposing surface 13*a*11. In that case, the film end surface 8*a* of the film 8 abuts against the regulating portion 13*b* of the flange (left side flange) 13 on the side on which the film 8 shifted, so that the film inner surface 8*b* slides on the first opposing surface 13*a*11 (of the left side flange) 13 in FIG. 9. As described above, the contour of the first opposing surface 13*a*11 is greater than the opposing surface 13*a*1 in Comparison Example 1. As a result, the film 8 inclines so that the right end portion side of the film 8 inclines toward the upstream side with respect to the recording material feeding direction with an angle β (<α) relative to the left end portion side of the film 8.

Further, as in Comparison Example 2, shown in FIG. 10, in a case in which the portion increased in contour is provided on the downstream side with respect to the recording material feeding direction, the film 8 inclines so that the right end portion side of the film 8 inclines toward the upstream side with respect to the recording material feeding direction with an angle γ relative to the left end portion side of the film 8.

When the angles β and γ of FIGS. 9 and 10 are compared with each other, the angle β is less than the angle γ. Therefore, in a case in which the first opposing surface 13*a*11 of the flange 13 is provided on the upstream side with respect to the recording material feeding direction, the film shifting force can be reduced compared with a case in which the first opposing surface 13*a*11 is provided on the downstream side with respect to the recording material feeding direction.

In the fixing device 31 of this embodiment, when the shift of the film 8 generates, the first opposing surface 13*a*11 with the large contour regulates the rotation orbit of the film 8. For that reason, an inclination angle of the film 8 can be decreased, so that the shifting force of the film 8 can be reduced and thus, breakage of the film end portion can be suppressed. Further, the length L21 of the first opposing surface 13*a*11 is short, and, even when the contour at this portion is increased, a rotation resistance of the film 8 can be suppressed. Further, the second opposing surface 13*a*12 is provided, so that it is possible to prevent the film 8 from falling out of the flange 13.

Embodiment 2

Another embodiment of the fixing device 31 will be described. In this embodiment, only a constitution different from the constitution of Embodiment 1 will be described.

The fixing device 31 of this embodiment is shown in parts (a) and (b) of FIG. 11 and FIG. 12. Part (a) of FIG. 11 is a schematic view when the flange 13 is seen from a side opposite from the pressing roller 9, and part (b) of FIG. 11 is a schematic view when the flange 13 is seen from an outside thereof with respect to the film longitudinal direction. FIG. 12 is a perspective view when the right side flange 13 is seen from the upstream side with respect to the recording material feeding direction.

As shown in parts (a) and (b) of FIG. 11 and FIG. 12, the flange 13 in this embodiment is provided with the first opposing surface 13*a*11 and the second opposing surface 13*a*12 at an entirety of the supporting portion 13*a* of the flange 13 with respect to a circumferential direction. A stepped portion between the first opposing surface 13*a*11 and the second opposing surface 13*a*12 constitutes the inclined surface 13*a*13 smoothly connecting the first opposing surface 13*a*11 and the second opposing surface 13*a*12.

The fixing device 31 according to this embodiment is capable of achieving an effect similar to that of Embodiment 1. Further, the shifting force of the film 8 can be reduced, so that, similarly as in Embodiment 1, generation risks of the film slip and the film torsion can be reduced.

Embodiment 3

Another embodiment of the fixing device 31 will be described. In this embodiment, only a constitution different from the constitution of Embodiment 1 will be described.

The fixing device 31 of this embodiment is shown in parts (a) and (b) of FIG. 13 and FIG. 14. Part (a) of FIG. 13 is a schematic view when the flange 13 is seen from a side opposite from the pressing roller 9, and part (b) of FIG. 13 is a schematic view when the flange 13 is seen from an outside thereof with respect to a thrust direction of the film 8. FIG. 14 is a perspective view when the right side flange 13 is seen from the upstream side with respect to the recording material feeding direction.

As shown in parts (a) and (b) of FIG. 13 and FIG. 14, the flange 13 in this embodiment is provided with the first opposing surface 13*a*11 and the second opposing surface 13*a*12 on the upstream side of the supporting portion 13*a* of the flange 13 with respect to the recording material feeding direction. With respect to the longitudinal direction of the film 8, the first opposing surface 13*a*11 and the second opposing surface 13*a*12 constitutes a smoothly connected the inclined surface.

The fixing device 31 according to this embodiment is capable of achieving an effect similar to that of Embodiment 1.

Another Embodiment

In the fixing devices 31 of Embodiments 1 to 3, each of the flanges 13 includes the two opposing surfaces 13*a*11 and 13*a*12 with respect to the longitudinal direction of the film 8, but each of the flanges 13 may include three or more opposing surfaces. For example, in a case in which three opposing surfaces are provided, it is only required that contours of the opposing surfaces are made larger with a decreasing distance from the regulating portion 13.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing device for fixing an image, formed on a recording material, on the recording material, said fixing device comprising:

a frame;

a cylindrical film rotatable while being contactable to the recording material;

a component portion engaging with said frame, said component portion including a supporting portion provided in an inside space of said film at a position opposing a longitudinal end portion of said film, said supporting portion including a first opposing surface opposing an inner surface of said film at the longitudinal end portion of said film, and a second opposing surface opposing the inner surface of said film on an inside of said first opposing surface with respect to a longitudinal direction of said film, and each of said first opposing surface and said second opposing surface is a surface forming a substantially right angle with an engaging surface, which is a surface on which said component portion engages with said frame and on which said component portion opposes a flat surface portion of said frame, and, when said component portion is seen in the longitudinal direction of said film, a contour of said first opposing surface is greater than a contour of said second opposing surface; and a roller contacting an outer peripheral surface of said film and configured to form a nip, in which the recording material is nipped and fed, between itself and said film.

2. The fixing device according to claim 1, wherein each of said first opposing surface and said second opposing surface has the substantially right angle falling in a range of 86° or more and 94° or less.

3. The fixing device according to claim 1, wherein said first and second opposing surfaces different in contour are provided only on a side upstream of said supporting portion on the basis of a phantom plane perpendicular to a center of the nip with respect to a recording material feeding direction.

4. The fixing device according to claim 1, wherein said first and second opposing surfaces, different in contour, are provided on both sides upstream and downstream of said supporting portion on the basis of a phantom plane perpendicular to a center of the nip with respect to a recording material feeding direction.

5. The fixing device according to claim 1, wherein between said first and second opposing surfaces, an inclined surface is provided.

6. The fixing device according to claim 1, wherein said component portion includes a regulating surface against which an end surface of said film runs when said film shifts in the longitudinal direction.

7. The fixing device according to claim 1, further comprising a heater contacting the inner surface of said film.

8. The fixing device according to claim 7, wherein the nip is formed between said film and said roller by said heater and said roller.

* * * * *